United States Patent [19]

Johnson

[11] 4,387,948

[45] Jun. 14, 1983

[54] SPARK PLUG WIRE TERMINAL AND METHOD FOR ATTACHING TERMINAL

[75] Inventor: Arthur D. Johnson, Muskego, Wis.

[73] Assignee: Wells Manufacturing Corporation, Fond du Lac, Wis.

[21] Appl. No.: 240,133

[22] Filed: Mar. 3, 1981

[51] Int. Cl.[3] ..... H01R 11/20

[52] U.S. Cl. ..... 339/97 R; 339/223 S

[58] Field of Search ..... 339/97 R, 97 C, 97 P, 339/223 S

[56] References Cited

U.S. PATENT DOCUMENTS

| | | | |
|---|---|---|---|
| 2,970,184 | 1/1961 | Blonder | 339/97 R |
| 3,599,171 | 8/1971 | Anderson | 339/97 C |
| 4,073,565 | 2/1978 | Raymond | 339/223 S |

FOREIGN PATENT DOCUMENTS

| | | | |
|---|---|---|---|
| 1514956 | 1/1968 | France | 339/97 C |

*Primary Examiner*—Joseph H. McGlynn
*Assistant Examiner*—Paula Austin

[57] ABSTRACT

An electrically conductive terminal adapted to be fixedly connected to the free end of a wire such as a spark plug wire. The terminal includes one end constructed to releasably clampingly engage a conductor such as a spark plug and an opposite end comprising a body adapted to house the free end of the spark plug wire. A stake member is provided for securing the other end of the terminal member to the spark plug wire and also for providing an electrical conductor between the core and the terminal. The stake member extends through a hole provided in the terminal and through the spark plug wire.

5 Claims, 5 Drawing Figures

SPARK PLUG WIRE TERMINAL AND METHOD FOR ATTACHING TERMINAL

FIELD OF THE INVENTION

The present invention relates to spark plug wire terminals and the like and to connectors adapted to connect a wire such as a spark plug wire to a conductor such as a spark plug. The invention also relates to a method for attaching such a terminal or connector to the end of such a wire.

BACKGROUND PRIOR ART

In the past the means commonly employed to form a connector or termination end of a spark plug wire included a generally cylindrical metal connector having one end adapted to fit over and clampingly engage a metal end of a spark plug and an opposite end adapted to fit over and surround an end of a spark plug wire. The end of the connector is adapted to be squeezed onto the wire such that it will grip the resilient insulation of the wire. One disadvantage of such terminals is that they may not firmly clampingly engage the end of the spark plug wire and can be pulled away from the wire or they may become loose as the wire becomes older and less resilient or as the wire is worn.

SUMMARY OF THE INVENTION

The invention includes the combination of an electrically conductive connector member adapted to be fixedly connected to the free end of a wire such as a spark plug wire. The connector member includes one end including means for releasably clampingly engaging a conductor such as a spark plug and the other end comprising a body adapted to house the free end of the spark plug wire. The combination also includes means for securing that other end of the connector member to the free end of the spark plug wire and for providing an electrical conductor between the core of the spark plug wire and the connector member. The means for securing includes a stake member adapted to extend through a hole in the body and into the spark plug wire.

In one embodiment of the invention the body includes a pair of apertures in spaced relation, and the stake member includes an electrically conductive staple having a pair of legs and a transverse member joining the legs, the legs being adapted to extend through the apertures and through the free end of the spark plug wire.

In one embodiment of the invention the body portion of the terminal is generally cylindrical and includes a web portion and a pair of legs extending from the web portion and adapted to surround the wire, the pair of legs of the body including ends which are spaced apart and define a gap therebetween. The gap is elongated and generally parallel to the longitudinal axis of the wire, and the legs of the staple can extend through the gap when the staple is forced through the spark plug wire.

The invention also includes a method for applying a spark plug wire terminal to the free end of a spark plug wire having a central electrically conductive core and an insulative sheath surrounding the central electrically conductive core. The method includes the step of forcing an electrically conductive member longitudinally onto the end of the wire, one end of the electrically conductive member including means for releasably clampingly engaging a spark plug and the other end being adapted to be clamped onto the free end of the spark plug wire and including a generally cylindrical member adapted to house the wire. The method also includes the step of forcing a stake member through an aperture in the cylindrical member and into the wire to secure the electrically conductive member to the wire.

Various other features and advantages will be apparent from reference to the following description of a preferred embodiment, from the claims, and from the drawings.

Figure 1:
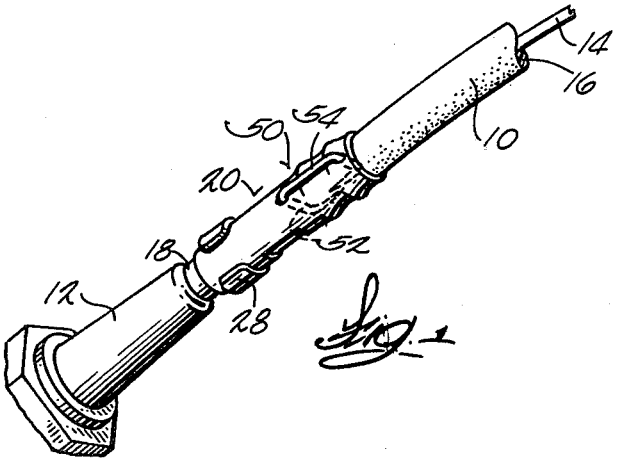
FIG. 1 is a perspective view of a spark plug wire of an internal combustion engine connected to a spark plug.
Figure 3:
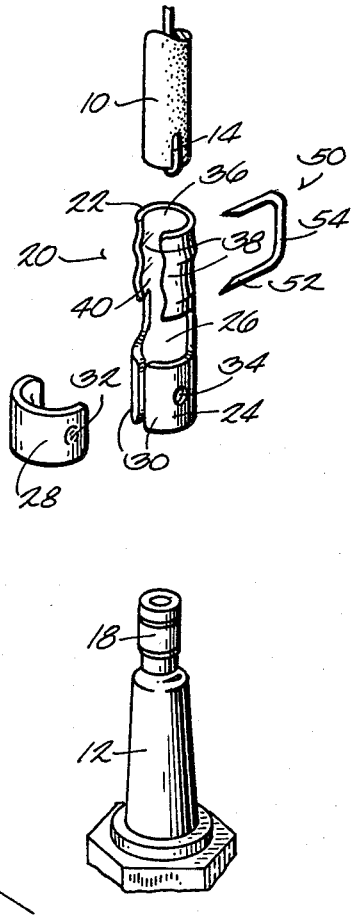
FIG. 3 is an exploded perspective view of the connector and the end of the spark plug wire.
Figure 4:
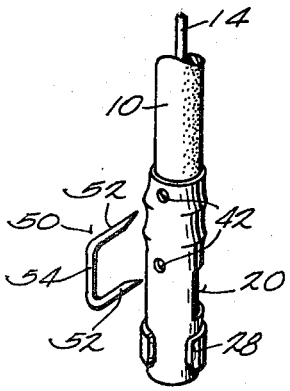
FIG. 4 is a view similar to FIG. 3 but showing the connector positioned on the end of the spark plug wire.

Before describing a preferred embodiment of the invention, it will be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Illustrated in FIG. 1 is a spark plug wire 10 adapted to extend between a distributor of an internal combustion engine (not shown) and a spark plug 12 shown only fragmentarily. The spark plug wire 10 includes a central core 14 of electrically conductive material and a surrounding insulative layer or sheath 16 comprised of an electrically insulative material, that material being flexible, resilient and relatively soft. The spark plug 12 is conventional and includes an end portion 18 adapted to support a spark plug wire terminal 20.

Means are further included for providing an electrical connection between the end of the spark plug wire 10 and the spark plug 12, this means including a spark plug terminal 20 having one end 22 adapted to surround and engage the free end of the spark plug wire 10 and also to be electrically connected to the conductor core 14 of the spark plug wire. The spark plug wire terminal 20 also includes an opposite generally cylindrical end 24 adapted to be slideably forced onto the end 18 of the spark plug 12 and to releasably clampingly engage the spark plug.

In the illustrated construction, the terminal 20 is comprised of an electrically conductive metal such as steel, though in other arrangements other electrically conductive materials such as copper or aluminum could be used. The terminal 20 is formed from a thin metal strip, one end of the strip being rolled to form the generally cylindrical end portion 24 adapted to engage the spark plug. The opposite end is similarly formed by rolling the end of the strip to form a generally cylindrical end 22 of sufficient diameter that it can be slideably forced onto the end of the spark plug wire. The opposite ends of the terminal are joined by a connecting section or web 26.

The end 24 of the terminal 20 including means for engaging the spark plug 12 is at least partially surrounded by a spring clip 28 covering the free ends 30 and holding them together such that they firmly grip the spark plug. The spring clip 28 is comprised of a strip of metal bent in a C-shape so as to form a partial cylinder and adapted to clampingly engage the end 24 of the terminal. Means are also provided to prevent movement of the spring clip on the terminal end 24. This means comprises an inwardly extending projection 32 formed in one end of the spring clip, the projection 32 being adapted to be housed in an aperture 34 in the terminal end 24.

Referring more particularly to the end 22 of the terminal surrounding the spark plug wire, it includes a generally cylindrical body adapted to surround the spark plug wire and including a web portion 36 and a pair of legs 38 extending from the web 36 and partially surrounding the wire. The legs 38 are not of sufficient length to completely surround the wire, and their ends are spaced apart to define an elongated gap 40 parallel to the longitudinal axis of the wire 10. The cylindrical portion 22 has an inside diameter which will slideably receive the wire. Once the cylindrical portion is in place, the legs 38 can be pinched against the wire 10 so as to squeeze the wire and secure the terminal on the spark plug wire.

The web portion 36 of the cylindrical portion 22 of the terminal also includes a pair of holes or apertures 42, the holes being spaced apart and aligned with the longitudinal axis of the wire and the holes being located opposite the elongated longitudinal gap 40 formed by the ends of the legs 38.

Means are further provided for staking the terminal 20 to the end of the spark plug wire 10 to thereby prevent removal of the terminal from the wire and for providing an electrically conductive connection between the core 14 of the spark plug wire 10 and the terminal 20. While the means for staking the terminal to the end of the spark plug wire can have various configurations, in the illustrated arrangement it includes a staple 50. The staple includes a pair of spaced parallel legs 52 joined by a transverse member 54. The legs 52 are spaced apart by the same distance as the holes 42 in the web portion 36 of the terminal 20, and the legs 52 each have a length which is somewhat greater than the diameter of the wire 10. In the illustrated arrangement the legs 52 of the staple 50 are adapted to be positioned in the holes 42, and then the staple can be driven through the wire until the transverse member 54 engages the web 36 and the legs 52 of the staple extend through the center of the wire and project from the other side of the wire so as to extend through the gap 40.

Figure 5:
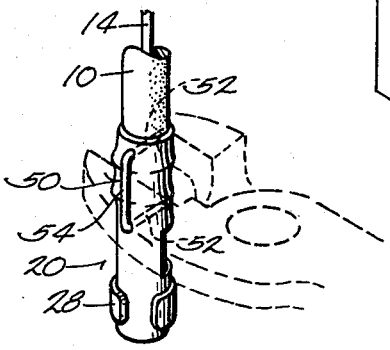
FIG. 5 is a view similar to FIG. 4 and showing the staple being forced through the wire.
Figure 2:
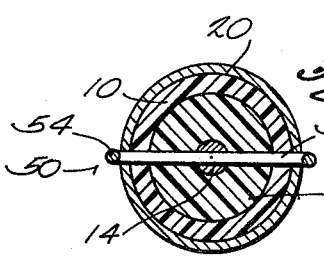
FIG. 2 shows an enlarged cross section view of the connector shown in FIG. 1 and being adapted to form an electrically conductive connection between the spark plug wire and the spark plug.

In the employment of the apparatus described above, a spark plug terminal may be applied or fixed on the end of a spark plug wire in the following manner. A portion of the insulation 16 at the end of the spark plug wire is removed so as to expose approximately ½" of the wire core 14. The exposed core 14 is folded back such that it lays against the outside surface of the insulation 16. The terminal 20 is then slipped over the end of the wire 10 to clamp the exposed end of the wire core 14 between the terminal and the exterior surface of the insulation. The legs 38 of the cylindrical portion 22 can then be squeezed against the wire 10 using a pair of pliers. The legs 52 of the staple are then placed through the holes 42 in the web 36 such that the staple 50 can be driven or forced through the wire 10. The staple can be forced through the wire by tapping it with a hammer or by employing a pair of pliers in the manner illustrated in FIG. 5. The staple 50 is driven through the wire until the legs 52 of the staple project through an opposite side of the wire and through the longitudinal gap 40 between the ends of the legs 38, and the transverse portion 54 of the staple engages the external surface of the web 36. The ends of the legs 52 of the staple are then folded toward each other and firmly against the surface of the wire. It will be noted that when the legs 52 of the staple extend through the apertures 42 in the web and then project through the gap 40 between the ends of the legs 38, the legs 52 of the staple pass through the center of the wire and will make electrical contact with the conductor core 14. The staple thus functions as an additional means of insuring a positive electrical connection between the conductor core 14 and the terminal 20.

One of the advantages of the construction described above is that it provides a spark plug wire terminal which is firmly anchored to the spark plug wire. The prior art spark plug terminals, wherein the terminal is crimped around the resilient insulative layer, have been found to pull away from the end of the wire when a tensile force of 10 to 16 lbs. is applied to the terminal. The force required to pull such a terminal away from the end of the wire becomes even less as the wire ages and becomes less resilient or worn. With the construction of the invention described above, a tensile force exceeding 26 to 35 lbs. is required to pull the terminal off of the end of the wire. Additionally, since the terminal is staked to the wire, even though the surface of the wire becomes worn or less resilient, the terminal will remain firmly secured to the end of the wire.

Another of the advantages of the invention is that the terminals can be firmly anchored on the end of a wire by a typical consumer using ordinary tools such as a hammer or a pair of pliers. No special skill or training nor special crimping tools are necessary.

Various features of the invention are set forth in the following claims.

I claim:

1. A combination comprising a spark plug wire having a central electrically conductive core and a layer of insulative material surrounding said core, said spark plug wire having a free end, and an electrically conductive connector member adapted to be fixedly connected to said free end of said spark plug wire, said connector member including opposite ends, one of said ends including means for releasably clampingly engaging a spark plug and the other of said ends comprising a body adapted to house said free end of said spark plug wire, said body including a pair of spaced apart apertures, and means for securing said other end of said connector member to said free end of said spark plug wire, said means for securing including a metal staple having a pair of legs and a transverse member joining said legs, said legs being adapted to extend through said apertures and through a central portion of said spark plug wire, and said body being generally cylindrical and including a web portion, and a pair of legs extending from said web portion and adapted to surround said wire, said pair of legs of said body including ends which are spaced apart and define a gap therebetween, said gap being elongated and being generally parallel to said longitudinal axis of the wire, and wherein said legs of said metal staple can extend through said gap when said staple is forced through the spark plug wire.

2. The combination as set forth in claim 1 wherein said apertures define a line parallel to said electrically conductive core.

3. The combination set forth in claim 1 wherein said legs of said metal staple are adapted to extend through said apertures and through said spark plug wire so as to be in electrically conductive contact with said central electrically conductive core for providing an electrical conductor between said core and said connector member.

4. An electrically conductive terminal adapted to be attached to a wire and to releasably engage an electrically conductive member, the wire having a central electrically conductive core and a layer of insulative material surrounding said core, and said wire having a free end, said electrically conductive terminal comprising a connector member adapted to be fixedly connected to the free end of the wire, said connector member including opposite ends, one of said ends including means for releasably clampingly engaging the electrically conductive member and the other of said ends comprising a body adapted to house the free end of said wire, said body being generally cylindrical and including a web portion, said web portion including a pair of apertures in spaced relation and a pair of legs extending from said web portion and adapted to surround said wire, said pair of legs of said body including ends which are spaced apart and define a gap therebetween, said gap being elongated and being generally parallel to said longitudinal axis of the wire, and means for securing said other end of said connector member to said free end of said wire, said means for securing including an electrically conductive staple having a pair of legs and a transverse member joining said legs, said legs being adapted to extend through said apertures and through a central portion of said wire, and wherein said legs of said staple can extend through said gap when said staple is forced through the wire.

5. The electrically conductive terminal set forth in claim 4 wherein said staple is adapted to extend through said apertures and through said wire so as to be in electrically conductive contact with said core for providing an electrical conductor between said core and said connector member.

* * * * *